United States Patent [19]

Otagoshi

[11] 3,961,175

[45] June 1, 1976

[54] PORTABLE BATTERY OPERATED ELECTRIC LIGHT

[75] Inventor: Hitoshi Otagoshi, Tokyo, Japan

[73] Assignees: Matsushita Electric Industrial Co., Ltd., Osaka; Aoki Electric Industrial Co., Ltd., Tokyo, both of Japan

[22] Filed: Jan. 23, 1975

[21] Appl. No.: 543,344

[30] Foreign Application Priority Data

| | | |
|---|---|---|
| Feb. 4, 1974 | Japan | 49-13865[U] |
| Feb. 6, 1974 | Japan | 49-14678[U] |
| Feb. 7, 1974 | Japan | 49-15101[U] |

[52] U.S. Cl. ..... 240/10.63; 240/10.6 SD; 240/10.66; 240/10.67

[51] Int. Cl.[2] ..... F21L 5/00; F21L 7/00

[58] Field of Search ..... 240/10.65 D, 10.63, 240/10.66, 10.67

[56] References Cited

UNITED STATES PATENTS

| | | | |
|---|---|---|---|
| 1,769,436 | 7/1930 | Koretzky | 240/10.66 |
| 3,393,311 | 7/1968 | Dahl | 240/10.67 |
| 3,479,499 | 11/1969 | Dahl | 240/10.67 |

FOREIGN PATENTS OR APPLICATIONS

| | | | |
|---|---|---|---|
| 1,101,389 | 1/1968 | United Kingdom | 240/10.65 D |

*Primary Examiner*—L. T. Hix
*Assistant Examiner*—Russell E. Adams, Jr.
*Attorney, Agent, or Firm*—Burgess, Ryan and Wayne

[57] ABSTRACT

The invention discloses a portable battery-operated electric light comprising, in general, a main body consisting of a power source section for storing therein dry cells and a handle section formed integral with the power source section; an arm member having its one end pivoted to one end of the handle section; and a head section pivoted to the other end of the arm member. The head section includes a substantially dome-shaped reflector provided with a center hole through which a light bulb may be displaced into and out of the reflector in the direction of the optical axis thereof; a front light transmitting window formed at the front of the reflector; a rear light transmitting window formed through the housing of the head section at the back of the reflector; and a slide control switch. The slide control switch is so constructed and operatively coupled to a light bulb holder that when it is pushed to the forward position, the light bulb is displaced into the reflector and is turned on to emit the light through the front window; when it is pushed to the rear position, the light bulb is displaced out of the reflector and is turned on so that the light is emitted through the rear window; and when it is moved to the intermediate position between the forward and rear positions, the light bulb is placed within the center hole of the reflector and remains turned off.

14 Claims, 9 Drawing Figures

PORTABLE BATTERY OPERATED ELECTRIC LIGHT

BACKGROUND OF THE INVENTION

The present invention relates to a portable battery-operated electric light which may be used in various modes.

In general, the use of the conventional portable electric lights is limited. For instance, they are used only to illuminate the front or to send the light signals. There are also available dual-function portable electric lights of the type in which an electric light bulb is placed into or retracted from a reflector by a slide control switch. When the light bulb is placed into the reflector and is turned on, the electric light is used for illuminating the front, but when the light bulb is retracted out of the reflector, the elctric light is used as a signal light.

SUMMARY OF THE INVENTION

One of the objects of the present invention is, therefore, to provide a portable battery-operated electric light which may be used in at least three modes; in the first mode, the electric light being used in a conventional manner for illuminating the front, in the second mode, it being used as a search light, and in the third mode, it being used as a lantern.

Another object of the present invention is to provide an optically efficient portable electric light in which when a light bulb is placed into a reflector, the front illuminating light may be prevented from leaking backwardly through the reflector, but when the light bulb is retracted out of the reflector and is turned on to illuminate around the electric light through a rear window, the light is prevented from leaking through the reflector toward a front window.

Briefly stated, a portable battery-operated electric light in accordance with the present invention comprises, in general, a main body consisting of a power source section for storing therein dry cells and a handle section formed integral with the power source section; an arm member having its one end pivoted to one end of the handle section; and a head section pivoted to the other end of the arm member. The head section includes a substantially dome-shaped provided with a center hole through which a light bulb may be displaced into or out of the reflector in the direction of the optical axis thereof; a front window formed at the front of the reflector; a rear window formed through the housing of the head section at the back of the reflector; and a slide control switch selectively movable among a forward position, a rear position and an intermediate position therebetween. When the slide control switch is moved to the forward position, the light bulb is displaced into the reflector, and is turned on so that the light is projected through the front window. When the control switch is moved to the rear position, the light bulb is displaced away from the reflector and is also turned on so that the light is projected through the rear window to illuminate around the electric light. When the contrl switch is moved to the intermediate position, the light bulb is turned off. The angle of the arm member and the angular position of the head section may be suitably adjusted for the optimum use of the electric light.

DESCRIPTION OF THE PREFERRED EMBODIMENT

Figure 3:
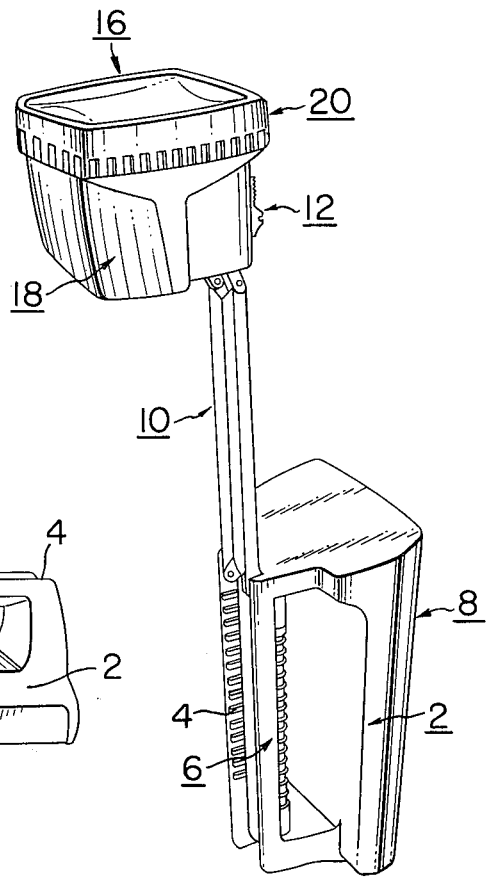
FIG. 3 is a perspective view thereof when used as a lantern.
Figure 1:
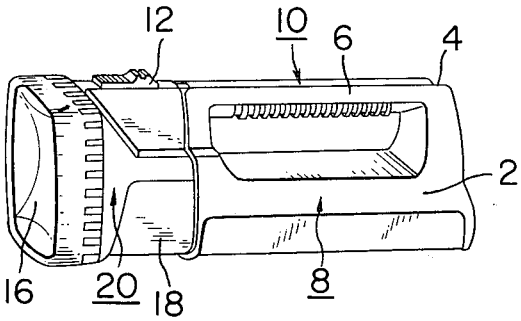
FIG. 1 is a perspective view of a portable electric light in accordance with the present invention when used as a front illuminating electric light.
Figure 2:
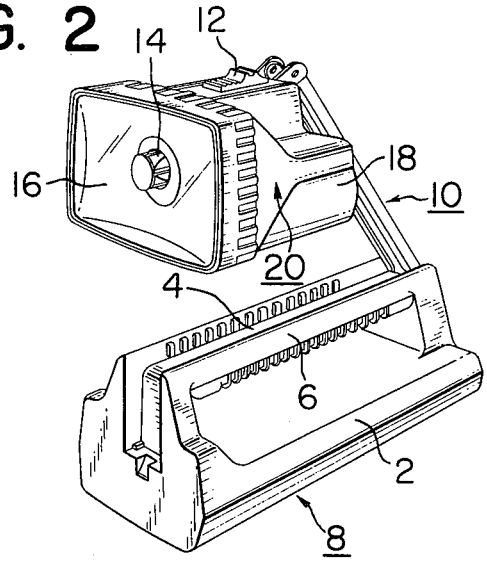
FIG. 2 is a perspective view thereof when used as a search light.

Referring first to FIGS. 1, 2, and 3, a portable battery-operated electric light in accordance with the present invention comprises, in general, a main body 8 consisting of a power source section 2 housing dry cells and a handle section 6 formed integral with the power source section 2 upwardly thereof and provided with an arm receiving groove 4 formed in the longitudinal direction of the top surface of the handle section 6; an arm member 10 having its one end pivoted at one end of the arm receiving groove 4 in such a way that it may be received into or extended out of the arm receiving groove 4 as will be described in more detail hereinafter; and a head section 20 pivoted at the other end of the arm member 10 and including an electric light bulb 14, which may be displaced relative to a reflector 76 (See FIG. 4) in the direction of the optical axis thereof by a slide control witch 12, a front window 16 disposed in front of the reflector 76, and a rear window 18 formed backwardly of the reflector 76.

Figure 8:
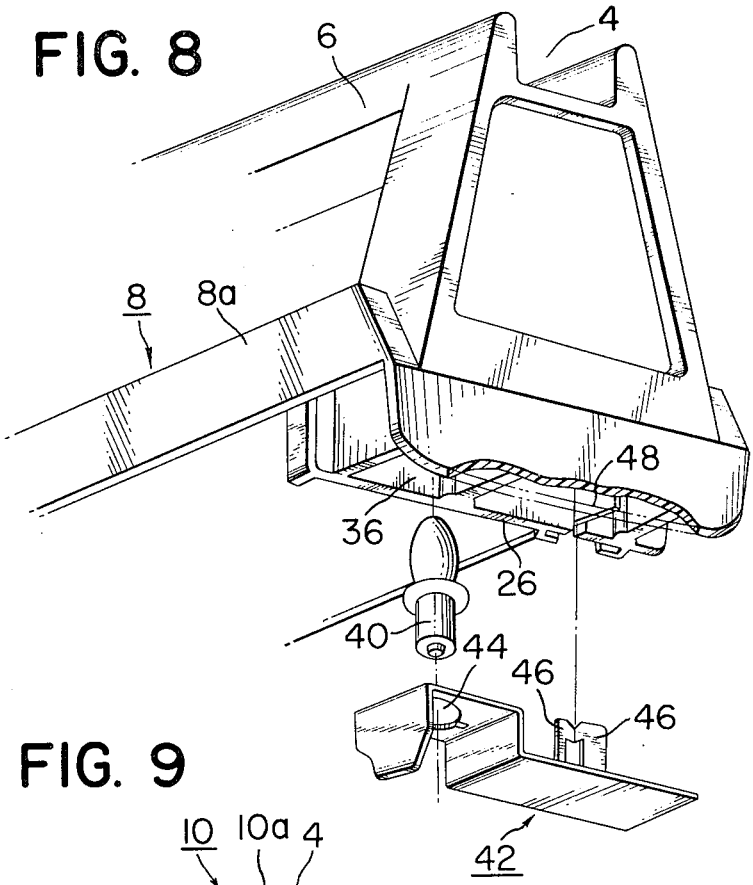
FIG. 8 is a perspective view of an auxiliary light bulb holding member.
Figure 9:
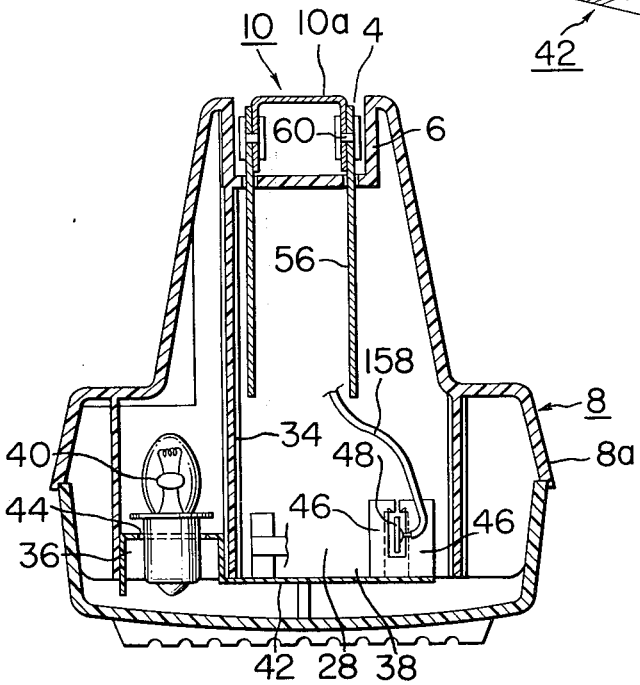
FIG. 9 is a sectional view thereof.

Next referring to FIGS. 4, 8, and 9, the construction of the main body 8 will be described. The main body 8 comprises, in general, a housing **8*a* made of plastic and defining the power source section 2 and the handle section 6. A cover or bottom member 22 made of plastic is detachably attached with a screw 24 to the bottom opening of the power source section 2. The power source section 2 is divided into a front battery housing chamber 2a and a rear auxiliary lamp storage chamber 28 by a partition wall 26 disposed closer to the rear end wall of the case 2. Two battery cell groups each consisting of two SUM-1 dry cells C connected in series are juxtaposed within the battery storage chamber 2a in such a way that they are electrically conncted in series. Within the battery storage chamber 2a are placed a coiled spring 30 and a contact plate 32 for electrical contact with the electrodes of the dry cells C. The auxiliary lamp storage chamber 28 is divided by a partition wall 34 extended downwardly from the handle section 6 into a small chamber 36 and a large chamber 38 as best shown in FIG. 9. An auxiliary lamp 40 is stored within the small chamber 36. An auxiliary lamp supporting plate 42 made of an elastic thin plastic sheet has its one end portion so bent as to form an inverted U-shaped section, and has a pair of hook-shaped members formed at the other end in opposed and contact relation as best shown in FIG. 8. An auxiliary lamp receiving hole 44 is formed through the top of the inverted U-shaped section at one end of the supporting plate 42. A projection 48 of the contact plate 32 extending into the large chamber 38 is detachably engaged with the pair of hook members 46 so that the supporting plate 42 is prevented from being detached from the housing 8a. To remove the auxiliary lamp 40, one pulls the supporting sheet 42 to release the hook members 46 from the projection 48, and then removes the auxiliary lamp 40 from its receiving hole 44.**

The handle section 6 comprises hollow rear and front legs 50 and 50 formed integral with the rear and front end walls of the power source section 2, and a horizontal member 54 bridging between the rear and front legs 50 and 52. The arm receiving groove 4 is formed in the top surface of the horizontal member 54 over the whole length thereof.

Figure 4:
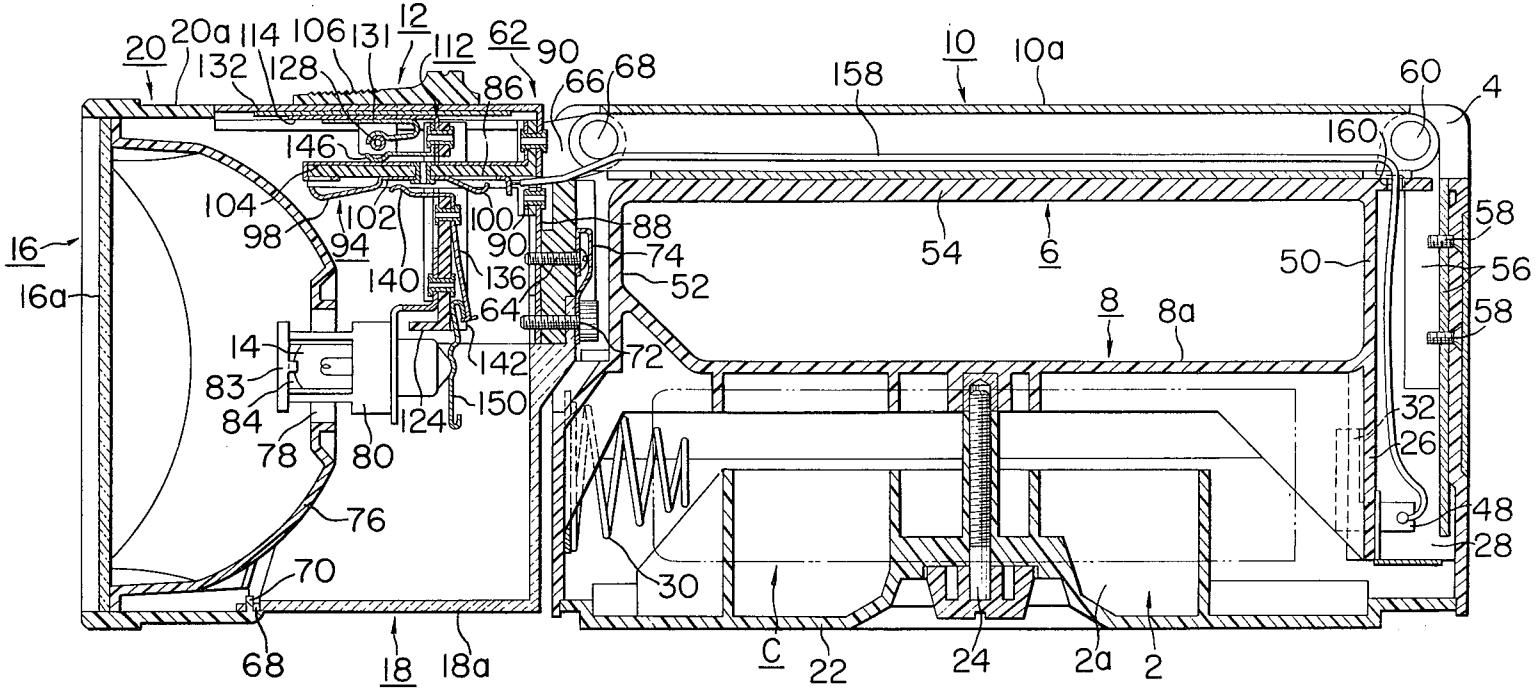
FIG. 4 is a longitudinal sectional view thereof.

Referring still to FIG. 4, the arm member 10 will be described. An arm main body 10*a* of the arm member 10 has its one end hinged with rivets 60 to the upper end of a metallic hinge plate 56 which in turn is attached with screws 58 to the inner surface of the left wall of the rear leg 50 in FIG. 4. The upper end of the hinge plate 56 is extended into the arm receiving groove 4 of the handle section 6. The arm main body 10*a* is made of a metal and is in the form of a channel. It has a length substantially equal to that of the arm receiving groove 4 and has such a cross section that is may be received within the arm receiving groove 4.

Still referring to FIG. 4, the head section 20 will be described. The head section 20 comprises, in general, a head housing 20*a* made of plastic. An opening formed in the top wall of the head housing 20a is covered with a L-shaped metallic switch mounting plate 62 which in turn is attached with a screw 64 to the rear wall of the head housing 20a. A hinge plate 66 formed integral with and extended from the upper end of the vertical leg 88 of the L-shaped switch mounting plate 62 is pivoted with a rivet 68 to the other end of the main body 10*a* of the arm 10. Thus, the head section 20 is pivoted to the arm member 10. A transparent plastic front lighting plate 16a covers the front opening 16 of the housing 20*a*. The lower half of the side walls and the rear half of the bottom wall of the head housing 20*a* is open, and is covered with a detachable rear window cover made of a transparent plastic, but the undulations are formed in the inner surface of the rear cover 18*a* so that the rear cover 18*a* seems to be semitransparent. The rear cover 18*a* is detachably attached to the housing 20*a* with an engaging projection 70 extended from the housing 20*a* being fitted into an engaging hole 68 formed at the front end of the cover 18*a* and with the rear end of the rear cover 18*a* being attached to the rear wall of the housing 20*a* with a screw 72. The screw 72 is connected to the screw 64 with a connecting strip 74 made of a thin plastic sheet so that the screw 72 may be prevented from falling off when it is unscrewed.

The dome-shaped reflector 76 is attached to the front opening of the housing 20*a*, and is provided with a lamp hole 78 at the center thereof through which is displaced the lamp 14 in a manner to be described in detail hereinafter. The inner surface; that is, the reflecting surface of the reflector 76 is metal plated, and a front transparent plate 16a is placed in front of the reflector 76. The rear cover 18a is placed at the rear window 18 behind the reflector 76.

The lamp 14 may be advanced into the inside of the reflector 76 through its ccenter hole 78, and may be also retracted backwardly of the reflector 78 as will be described in detail hereinafter. The lamp 14 is encased in a cylindrical cap 80 having an end plate 82 and a plurality of equiangularly spaced apart column-shaped members formed integral with the cap 80 in the direction in parallel with the axis thereof. A light shielding cap 83 is attached to the free end of the cap 80.

The slide control switch 12 is mounted upon the switch mounting plate 62, and has a dual function of turning on and off the lamp 14 and advancing the lamp 14 into or retracting the lamp 14 out of the reflector 76 through its center hole 78. That is, when the lamp 14 is displaced into the reflector 76, it is turned on. When it is positioned within the center hole 78, it is turned off. When it is retracted out of the reflector 76, it is turned on again. In other words, when the lamp 14 is displaced forwardly or backwardly, it is turned on, then turned off, and again turned on.

Figure 5:
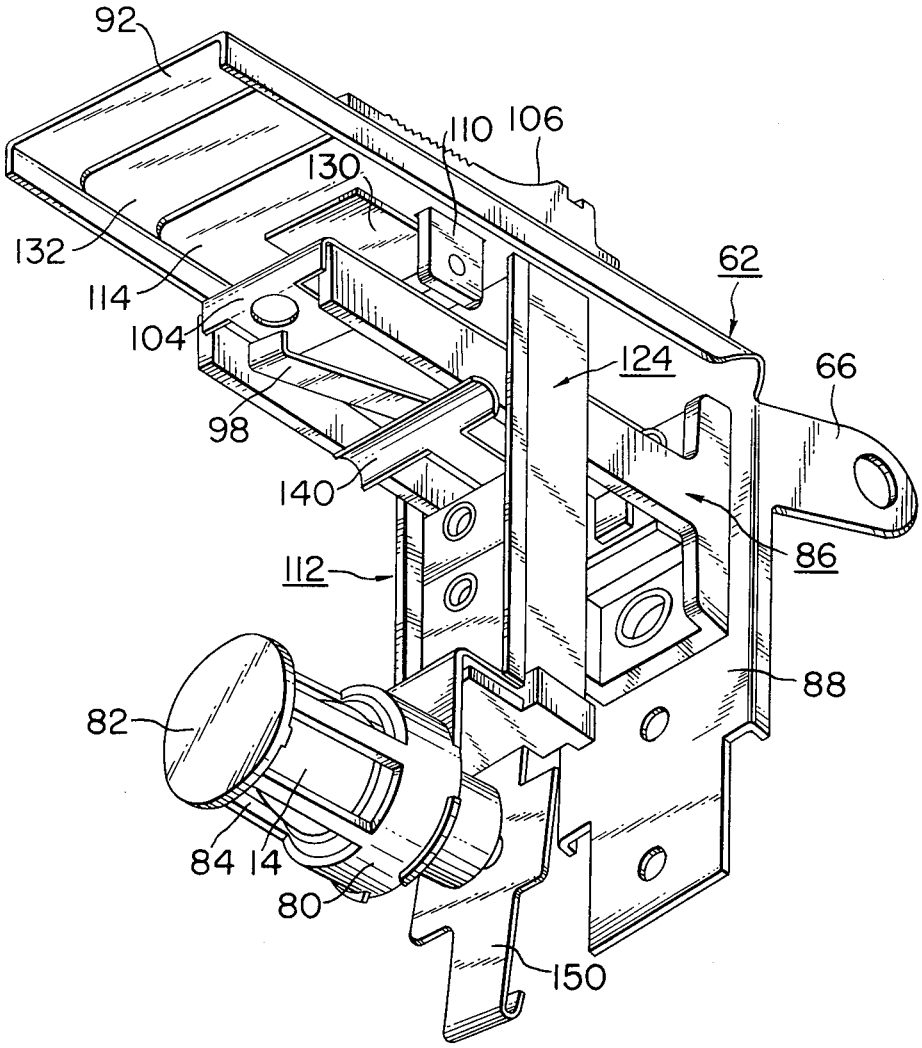
FIG. 5 is a perspective view of a slide control switch thereof.
Figure 6:
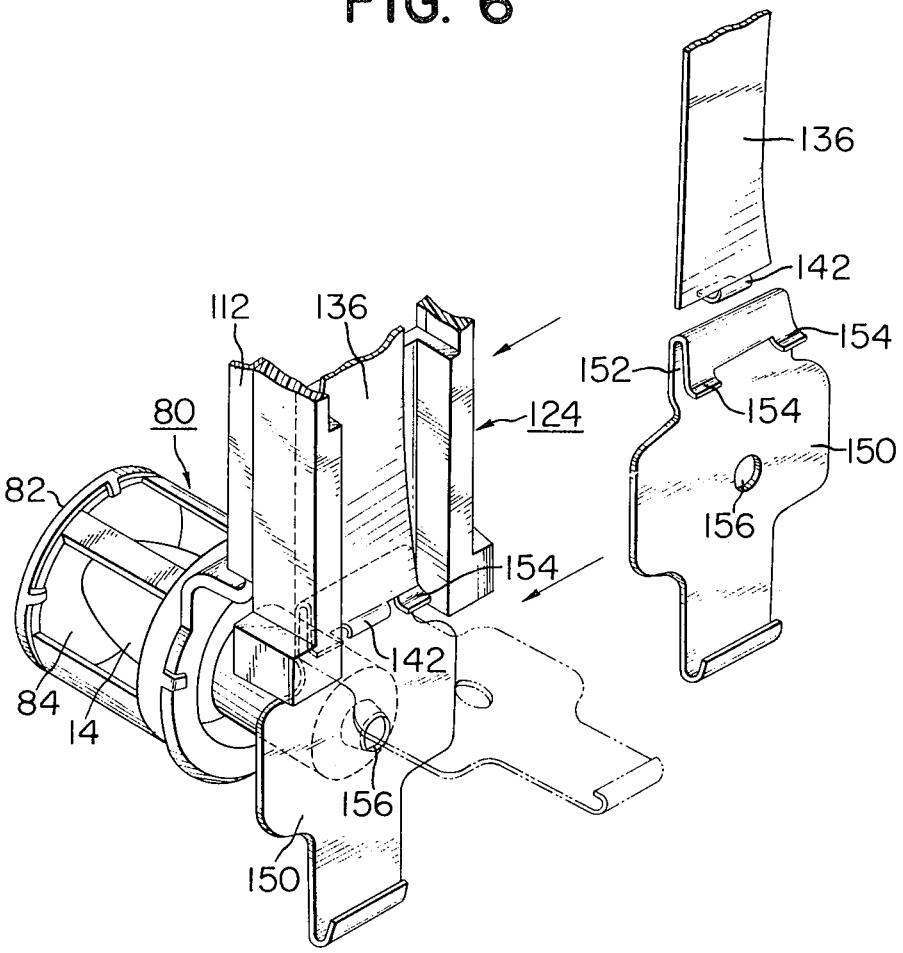
FIG. 6 is a perspective view of a light bulb holding member thereof.
Figure 7:
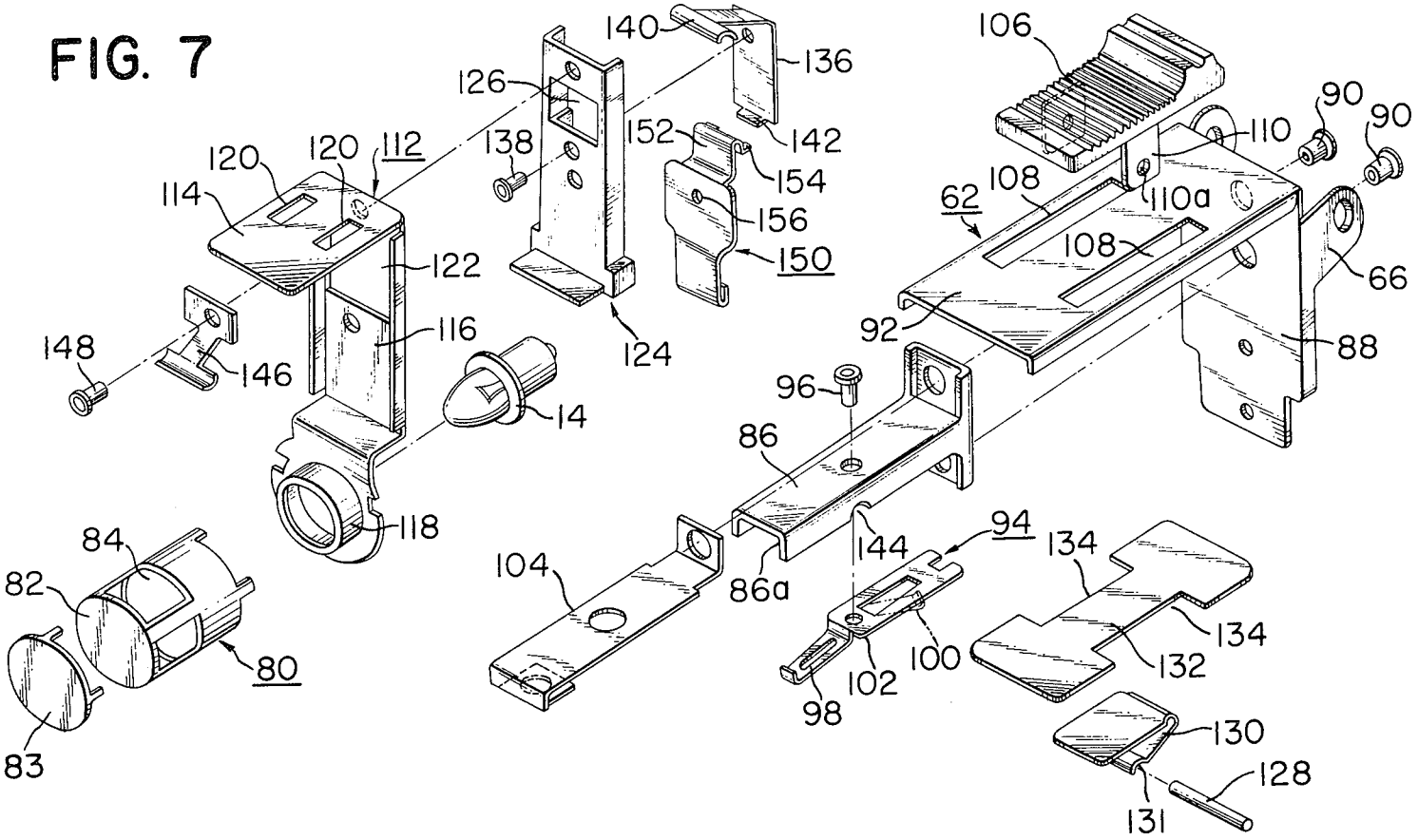
FIG. 7 is an exploded perspective view of the slide control switch and the light bulb holding member.

Next referring to FIGS. 5, 6, and 7, the construction of the slide control switch 12 will be described in detail. A channel-shaped base member 86 made of an electrical insulating plastics is attached with a rivet 90 to the vertical leg 88 of the L-shaped switch mounting plate 62, is extended forwardly, and is spaced apart from the horizontal arm 92 of the switch mounting plate 62 by a suitable distance. A stationary contact plate 94 is placed within the channel 86a of the base 86 and is securely attached thereto with a rivet 92. The stationary contact plate 94 has a front projection 98 extending downwardly slanting from the front end thereof, a rear projection 100 struck out so as to slant downwardly backwardly, and a recessed turn-off portion 102 between the front and rear projections 98 and 100. A lead plate 104 is placed over the base member 86 and has its rear end securely attached thereto with the rivet 90. The other end of the lead plate 104 is folded back as best shown in FIG. 7. An operating knob 106 made of plastic is attached to the upper surface of the horizontal arm 92 of the switch mounting plate 62 for slidable movement in the longitudinal direction. Two parallel guide slots 108 are formed through the horizontal arm 92 of the switch mounting plate 62. Two guide legs 110 are extended downwardly from the knob 106 and are fitted into the guide slots 108, respectively.

A metallic slide plate 112 is adapted to slide in unison with the knob 106 within the head housing 20, and comprises a top portion 114, a depending portion 116 extending downwardly from the rear end of the top portion 114, and a lamp holding portion 118 formed at the lower end of the depending portion 116. The lamp holding portion 118 is provided with a lamp receiving hole, and is fitted with the cap 80. The top portion 114 has two parallel slots 120 into which are slidably fitted the guide legs of the knob 106. The depending portion 116 is provided with an opening 122 large enough to permit the base member 86 to pass therethrough. A movable base 124 made of an electrically insulating plastic is attached to the depending portion 116 of the slide plate 112 for movement in unison therewith. It is provided with an opening 126 which coincides with the opening 122 of the lead plate 112.

A spring pin 128 is fitted into holes 110*a* of the guide legs 110 so as to be extended therebetween. A hook-shaped leaf spring 130 is placed between the spring pin 128 and the under surface of the top portion 114 of the slide plate 112. One end of the leaf spring 130 is formed semicircular in cross section to provide a pin receiving portion 131. Thus, the operating knob 106 is operatively coupled to the slide plate 112. There will be no play between the control knob 106 and the slide plate 112, so that a long service life may be ensured. A metallic slide plate 132 is interposed between the horizontal arm 92 of the switch mounting plate 62 and the top portion 114 of the slide plate 112, and is provided with recesses 134 into which are fitted the guide legs 110 of the knob 106. The slide plate 132 also serves to cover the guide slots 108 of the switch mounting plate 62.

A lead plate 136 is attached with a rivet 138 to the rear surface of the movable base plate 124, and a movable contact plate 140 is extended from the upper end of the lead plate 136. The lower end of the lead plate 136 is extended forwardly; that is, toward the movable base plate 124 to provide an engaging member 142. The free end of the movable contact 140 is in the form of a semicylinder so that it may contact with the front and rear projections 98 and 100 but may not contact with the turn-off portion 102 between them.

A semi-circular recess 144 is formed in the side wall of the channel 86*a* of the stationary base member 86 at a position corresponding to the turn-off portion 102 of the stationary contact plate 94, so that when the movable contact plate 140 reaches the turn-off portion 120, it drops into the semicircular grooves 144, thereby producing resistance against the sliding operation of the knob 106. That is, an operator may feel when the lamp is turned off.

A sliding contact plate 146 is attached with a rivet 148 to the depending portion 116 above its opening 122, is similar in configuration to the movable contact plate 140, and is made into sliding contact with the lead plate 104.

The lamp 14 is biased toward the cap 80 by an elastic lead plate 150. The upper end of the lead plate 150 is folded back into the inverted U-shape, and two projections 154 are horizontally backwardly and spaced apart from each other by a distance larger than the width of the engaging projection 142 of the lead plate 136. The upper end of the lead plate 150 is inserted between the lead plate 136 and the movable base plate 124, and engages the projection 142. Therefore, the lamp 14 is biased forwardly under the elastic force of the lead plate 136. A contact hole or recess 156 is formed in the lead plate 150 in opposed relation with a base contact of the lamp 14. Therefore, the replacement of the lamp 14 may be made in a simple manner only by opening and closing as shown in FIG. 6.

Next, referring back to FIG. 4, the electrical circuit will be described. One end of an insulated lead wire 158 is soldered to the projection 48 of the contact plate 32. The lead wire 158 extends through the rear leg 50, a hole 160 formed through the top wall thereof, and the arm main body 10*a*, and has its the other end soldered to the rear end of the stationary contact plate 94. A lead plate (not shown) is interposed between the coiled spring 30, which is pressed against the negative terminal of the series-connected battery cells C and the lower end of the hinge plate 58 of the arm member 10. Thus, a closed electrical circuit is established through the positive terminal of the serices-connected battery cell group, the contact plate 32, the lead wire 158, the stationary contact plate 94, the movable contact plate 140, the lead plate 136, the elastic lead plate 150, the lamp 14, the slide plate 112, the slidable contact plate 146, the lead plae 104, the rivet 90, the switch mounting plate 62, the hinge plate 66, the rivet 68, the arm main body 10*a*, the rivet 60, the hinge plate 56, the lead plate (not shown), the coiled spring 30, and the negative terminal of the series-connected battery cell group. This closed circuit may be opened or closed between the contact plates 140 and 94.

Next the mode of operation of the portable battery-operated electric light with the above construction will be described. When the control knob 106 is pushed forward: that is, in the left direction in FIG. 4, the lamp 14 extends into the relector 76, and the movable contact plate 140 contacts the front projection 98 of the stationary contact plate 94 so that the lamp 14 is turned on. The light emitted from the lamp 14 is transmitted through the openings 84 of the cap 80, reflected by the reflector 76, and is transmitted through the transparent plate 16*a*.

When the operating knob 108 is slightly returned backwardly so that the lamp 14 is placed within the center hole of the reflector 76, the movable contact plate 140 is moved away from the stationary contact plae 94 so that the lamp 14 is turned off.

When the operating knob 106 is further pushed backwardly, the lamp 14 is retracted away from the reflector 76 and the cap 82 attached to the shield cap 80 closes the center hole 78. The movable contact plate 140 engages the rear projection 100 of the stationary contact plate 94 so that the lamp 14 is turned on. The light emitted from the lamp 14 is projected through the openings 84 of the light shielding cap 80 and the rear lighting cover 18a into the lateral direction of the electric light. Since the center hole 78 of the reflector 76 is closed by the light shielding cap 83 of the cap 80, no light leaks through the center hole 78.

According to the present invention, the lamp 14 is covered with the cap 80, so that the light emitted from the lamp 14 placed into the reflector 76 will not leak out through the rear cover 18*a* while the light emitted from the lamp 14 placed behind the reflector 76 will not leak through the center hole thereof into the forward direction. Thus, the lighting efficiency may be greatly improved.

Referring back to FIG. 1, when it is desired to use the portable electric light in accordance with the present invention in the conventional maner in order to illuminate the front, the arm member 10 is retracted into the arm receiving groove 4 of the handle member 6, and the control knob or switch 12 is pushed to the forward position. Then the light is projected through the front window 16.

When the portable electric light is used as a search light, one raises the arm member 10 at a suitable angle as shown in FIG. 2 and adjusts suitably the angular position of the head case 20. The control switch 12 is pushed to the forward position so that the light is also projected through the front window 16. The mode of operation is very convenient to illuminate only a desired place or portion when, for instance, an automobile vehicle is repaired on a road or the like.

When used as a mood lantern, the arm member 10 is extended fully in line with the handle member 6 as shown in FIG. 3, and the control switch 12 is pushed to the rear position so that the light may be projected through the rear window 18 in the manner described hereinbefore. This mode of operation is convenient for illumination in a tent or in case of fishing at night. In another mode of the lantern operation, the arm member 10 is retracted into the arm receiving groove as shown in FIG. 1, and the electric light is hung or placed upright with the head case 20 at the top.

In addition to the above modes of operation, the portable electric light in accordance with the present invention may be used in the best convenient manner as the angular position of the head case 20 and the angle of the arm member 10 may be suitably adjusted and the illumination may be obtained through either of the front or rear window 16 or 18.

What is claimed is:

1. In a battery operated flashlight having a main body adapted to be gripped by an operator and to receive batteries therein and having contact means for engaging the terminals of batteries received therein, said main body having first and second ends, a head section including a socket for receiving a lamp, and interconnecting means interconnecting said main body and said head section; the improvement wherein said interconnecting means comprises arm means having one end pivoted to one end of said main body and another end pivoted to said head section whereby said head section may be moved to a position adjacent said other end of said body, said head section comprising:

a. a housing,
b. a first light transmitting window in said housing,
c. a substantially dome shaped reflector having a center hole, said reflector being in position in said housing behind said first window to reflect light out of said first window,
d. a second light transmitting window in said housing in a position behind said reflector,
e. externally controllable slide control means on said housing and having first and second end positions,
f. means connected to said slide control means for mounting said socket internally of said housing and aligned with said center hole of said reflector and behind said reflector, whereby said socket means moves in a direction axially of said reflector upon movement of said slide control means,
g. a light shielding cap substantially the same size as said central hole of said reflector,
h. means mounting said cap member for axial movement of said reflector with said socket, whereby said cap is positioned in said hole for blocking passage of light in said first end position of said control means and is positioned within said reflector in the second end position of said control means, and
i. switch means in said housing connected to said socket, and circuit means connecting said switch means to said contact means.

2. The flashlight of claim 1 further comprising a lamp mounted in said socket, said means mounted in said socket being mounted to position said lamp behind said reflector in said first end position of said control means and within said reflector behind said cap in said second end position of said control means.

3. The flashlight of claim 2 wherein said control means has a central position between said first and second end positions, and said switch means is mechanically coupled to said control means, said switch means being connected to energize said lamp in said first and second end positions of said control means and to de-energize said lamp in said central position of said control means.

4. The flashlight of claim 1 wherein said main body has a handle section formed integrally therewith and extending from one side of said main body, the surface of said handle section away from said main body having a groove extending longitudinally of said main body for receiving said arm member when said head section is moved to said position adjacent said other end of said body.

5. The flashlight of claim 1 wherein said means mounting said cap comprises a cylindrical member affixed to said socket and extending axially toward said first window, said cap being mounted on the end of said cylindrical member toward said first window, said cylindrical member having a side wall with a plurality of axially elongated openings equiangularly spaced apart, and further comprising a lamp mounted in said socket and enclosed in said cylindrical member.

6. The flashlight of claim 1 further including a lamp, said means mounting said socket comprising a electrically insulated base plate within said housing and being connected to move with said slide control means, a conductive lamp holding member having a receptacle for receiving said lamp, said lamp holding member being mounted on said base plate and serving as one electrical contact for said lamp, and a flexible conductive contact means mounted on said base plate and positioned to hold said lamp in said receptacle, said contact member serving as a second electrical contact for said lamp, said switch means comprising a stationary insulating base plate affixed within said housing and extending parallel to the axis of said reflector, stationary contact means comprising first and second contact surfaces spaced apart axially with respect to said reflector, and contact means on said conductive flexible contact means positioned to selectively engage said first and second contact surfaces in said first and second end positions respectively.

7. The flashlight of claim 1 wherein said main body further comprises an auxiliary electric lamp storage chamber, a partition wall in said main body separating said storage chamber into first and second chambers, and a flexible lamp holding sheet covering said first and second chambers, said lamp holding sheet having an inverted U-shaped section in said first chamber, said U-shaped section having a lamp holding hole for holding an auxiliary lamp, said lamp holding sheet further having a pair of flexible hook-shaped members in contact with each other and extending into said second chamber, said contact means of said main body extending into said second chamber, said hook-shaped members being positioned to engage said contact means of said main body for removably holding said lamp holding sheet to said main body.

8. A portable battery-operated electric light comprising a. a main body having front and rear longitudinal ends comprising a power source section for storing detachably dry cells therein, and a handle section for holding said electric light when in use;

b. an arm member having one end pivoted to rear end of said handle section; and
c. a head section having a lamp and pivoted to the other end of said arm member and placed axially at the front end of main body when the arm is placed along said handle section, said head section comprising
i. a substantially dome-shaped reflector provided with a center hole, ii. a front light transmitting window positioned in front of said reflector, iii. a rear light transmitting window positioned behind said reflector, iv. a slide control switch including means for holding said lamp for axial movement of said reflector aligned with said center hole, said switch being selectively slidable to a forward position with said lamp in said reflector, a rear position with said lamp behind said reflector, and an intermediate position between said forward and rear positions, said switch means comprising contact means positioned to energize said lamp in said forward and rear positions and to deenergize said lamp in said intermediate position, and v. cylindrical light shielding cap encasing said lamp, the side wall of said cap having a plurality of axially elongated openings equiangularly spaced apart, said cap having an open bottom and a top end substantially equal in size to said center hole of said reflector so that in said rear position of said switch said light shielding cap is retracted together with said lamp out of said reflector and said lamp is positioned to direct light through said rear light transmitting window, with said top end substantially optically sealing said center hole.

9. A portable battery-operated electric light as set forth in claim 8 wherein an auxiliary electric lamp storage chamber is defined within said power source section and partitioned by a partition wall of said main body into first and second chambers, a contact plate for connecting batteries being mounted in said main body and having a projection extending into said second chamber, a lamp holding sheet of a flexible plastic material extending over said first and second chambers, said lamp holding sheet having inverted U-shaped section extending in said first chamber, said U-shaped section having a lamp holding hole for holding an auxiliary lamp in said first chamber, said lamp holding sheet having a pair of elastic hook-shaped members in contact with each other extending into said second chamber at other end so that said pair of hook-shaped members firmly receive therebetween said projection of the contact plate, thereby removeably holding said lamp holding sheet in position so as to hold an auxiliary lamp is position in said lamp holding hole.

10. A portable battery-operated electric light as set forth in claim 8 wherein said main body comprises said power source section, and said handle section 17 formed integrally with said power source section at one side thereof, the surface of said hangle section away from said power source section having an arm receiving groove so that said arm member pivoted at one end of said handle member may be received into said arm receiving groove.

11. A portable battery-operated electric light as set forth in claim 8 comprising cylindrical light shielding cap encasing said lamp and having a side wall provided with a plurality of axially elongated openings equiangularly spaced apart and an open bottom end, the top at said cap being substantially equal in size to said center hole of said reflector so that said light shielding cap is retracted together with said lamp out of said reflector in said rear position of said switch, and said top end substantially optically seals said center hole in said rear position of said switch.

12. A portable battery-operated electric light as set forth in claim 8 wherein said slide control switch comprises a. a slidable control knob, b. a metallic slide plate and an electrically insulated movable base plate both of which are connected to said control knob to be slidably movable in unision therewith, c. a stationary base plate extending in the direction of the slidable movement of said movable base plate and attached to said head section, d. a stationary contact plate attached to said stationary base plate and having with a recessed portion at the midpoint thereof, a front projection extending slantingly toward said front window from one end of said recessed portion, and a rear projection extending slantingly away from said front window and from the other end of said recessed portion;

e. a movable contact plate attached to said movable base plate for engagement with said front and rear projections of said stationary contact plate, and for disengagement from said stationary contact plate at said recessed portion thereof;

f. a lamp holding member positioned at the end of said metallic slide plate away from said knob for holding said lamp and being electrically in contact with one terminal of said lamp;

g. a flexible conductive plate positioned to flexibly engage the other terminal of said lamp for urging said lamp into said lamp holder, so as to ensure that said lamp may be securely held in said lamp holder and for electrically contacting said other terminal of said lamp;

h. a conductive plate attached to said stationary base plate on a surface thereof different from the surface to which said stationary contact plate is attached, and electrically connected to said stationary contact plate; and i. a sliding contact plate attached to said metallic slide plate for slidably contacting said conductive plate.

13. A portable battery-operated electric light as set forth in claim 12 wherein a switch mounting plate having two parallel guide slots extending therethrough is interposed between said control knob and said metallic slide plate, said switching mounting plate being a part of the housing of said head section;

said control knob is provide with two guide legs slidably fitted into said two parallel guide slots, respectively; a spring pin is provided extending between said two guide legs of said control knob; and a hook-shaped leaf spring is forcibly interposed between said spring pin and said metallic slide plate so as to mechanically couple sad control knob to said metallic slide plate.

14. A portable battery-operated electric light as set forth in claim 12 wherein said flexible conductive plate is detachably attached to said movable base plate.

* * * * *